US011769962B2

(12) United States Patent
Lin et al.

(10) Patent No.: US 11,769,962 B2
(45) Date of Patent: Sep. 26, 2023

(54) ELECTRICAL CONNECTOR HAVING A REAR SEALING MEMBER FORMED IN A REAR CHAMBER PARTIALLY OCCUPIED BY A RIB OF AN INSULATIVE HOUSING

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Min-Han Lin, New Taipei (TW); Zhi-Feng Wang, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/503,055

(22) Filed: Oct. 15, 2021

(65) Prior Publication Data

US 2022/0123497 A1 Apr. 21, 2022

(30) Foreign Application Priority Data

Oct. 17, 2020 (CN) ..... 202011113397.7

(51) Int. Cl.
*H01R 13/52* (2006.01)

(52) U.S. Cl.
CPC ..... *H01R 13/521* (2013.01)

(58) Field of Classification Search
CPC ..... H01R 13/521; H01R 13/5202; H01R 13/5216; H01R 13/5219
See application file for complete search history.

(56) References Cited

U.S. PATENT DOCUMENTS

| | | | | |
|---|---|---|---|---|
| 9,812,827 | B2 * | 11/2017 | Guo | H01R 13/6594 |
| 9,929,513 | B2 * | 3/2018 | Wang | H01R 13/6591 |
| 9,997,859 | B2 * | 6/2018 | Yu | H01R 13/6581 |
| 10,804,641 | B2 * | 10/2020 | Zhou | H01R 13/405 |
| 10,992,088 | B2 * | 4/2021 | Su | H01R 13/6585 |
| 2016/0164218 | A1 * | 6/2016 | Lee | H01R 13/5202 439/587 |
| 2017/0222372 | A1 * | 8/2017 | Wang | H01R 13/405 |
| 2019/0267744 | A1 * | 8/2019 | Zhang | H01R 13/447 |

FOREIGN PATENT DOCUMENTS

CN 205752769 U 11/2016

* cited by examiner

*Primary Examiner* — Oscar C Jimenez
(74) *Attorney, Agent, or Firm* — Ming Chieh Chang

(57) ABSTRACT

An electrical connector includes: an insulative housing having a rear base and a front tongue; plural contacts extending rearward through the base and exposing to the tongue; an outer cover enclosing the insulative housing to define a rear chamber therebetween; and a sealing member formed in the chamber to seal an interface between the base and the outer cover and an interface between the base and the contacts, wherein the base has a rear face and a rib protruding rearward from the rear face into the rear chamber.

3 Claims, 9 Drawing Sheets

ELECTRICAL CONNECTOR HAVING A REAR SEALING MEMBER FORMED IN A REAR CHAMBER PARTIALLY OCCUPIED BY A RIB OF AN INSULATIVE HOUSING

BACKGROUND OF THE INVENTION

1. Field of the Invention

The present invention relates to an electrical connector comprising an insulative housing having a rear base and a front tongue, a plurality of contacts extending rearward through the base and exposing to the tongue, an outer cover enclosing the insulative housing to define a rear chamber therebetween, and a sealing member formed in the rear chamber to seal an interface between the base and the outer cover and an interface between the base and the contacts, wherein a rear face of the base exposing to the chamber is specially designed to achieve a better sealing effect.

2. Description of Related Arts

China Patent No. 205752769 discloses an electrical connector comprising an insulative housing having a rear base and a front tongue, a plurality of contacts extending rearward through the base and exposing to the tongue, a metallic shell enclosing the insulative housing, an insulative outer cover enclosing the metallic shell to define a rear chamber, and a sealing member formed in the chamber. Each of the plurality of contacts has a tail with an embedded portion and a soldering portion. The embedded portion divides the chamber into an upper region and a lower region larger in area than the upper region. Since the lower region has a larger area and due to surface tension and weight effects of glues in forming the sealing member, the larger lower region of the chamber may not be sufficiently covered by glues such that sealing effect may be reduced.

SUMMARY OF THE INVENTION

An electrical connector comprises: an insulative housing having a rear base and a front tongue; a plurality of contacts extending rearward through the base and exposing to the tongue; an outer cover enclosing the insulative housing to define a rear chamber therebetween; and a sealing member formed in the chamber to seal an interface between the base and the outer cover and an interface between the base and the contacts, wherein the base has a rear face and a rib protruding rearward from the rear face into the rear chamber.

DETAILED DESCRIPTION OF THE PREFERRED EMBODIMENT

Figure 1:
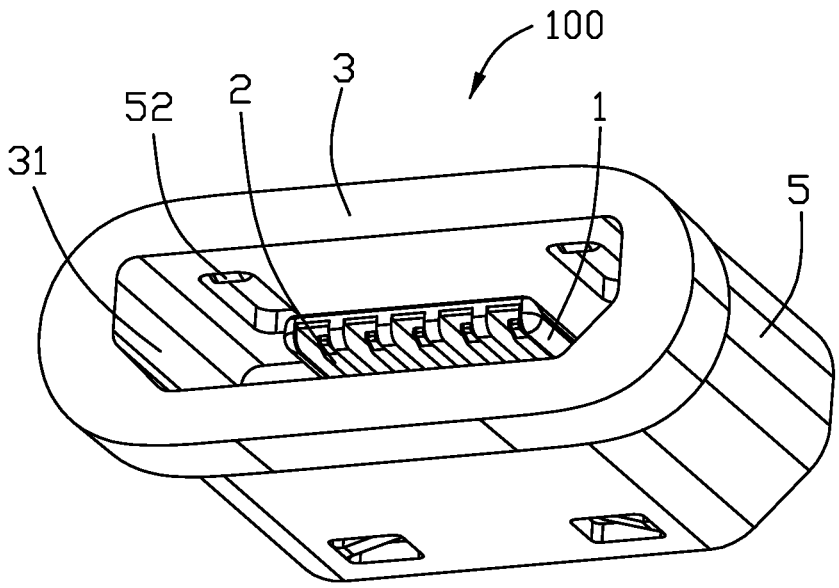
FIG. 1 is a perspective view of an electrical connector in accordance with the present invention.
Figure 2:
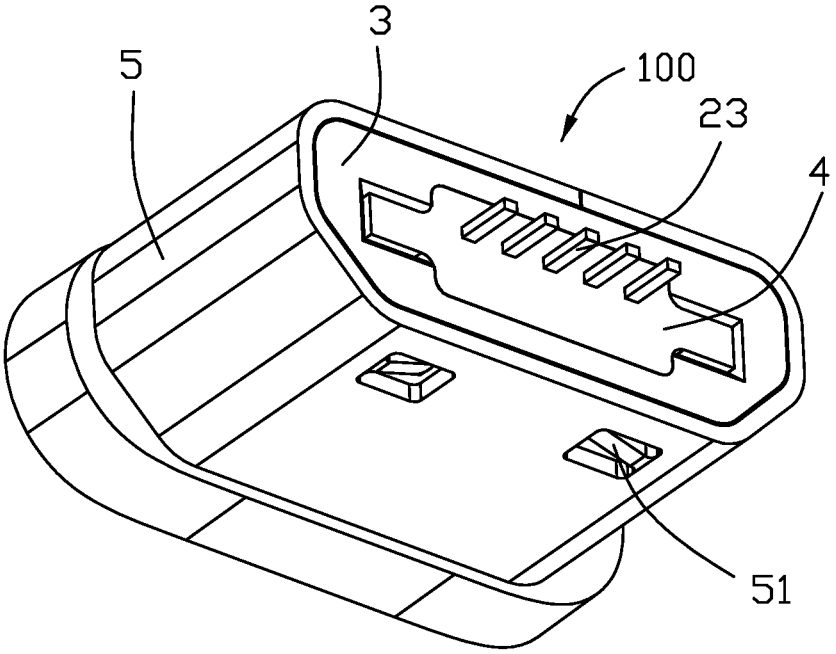
FIG. 2 is another perspective view of the electrical connector.
Figure 3:
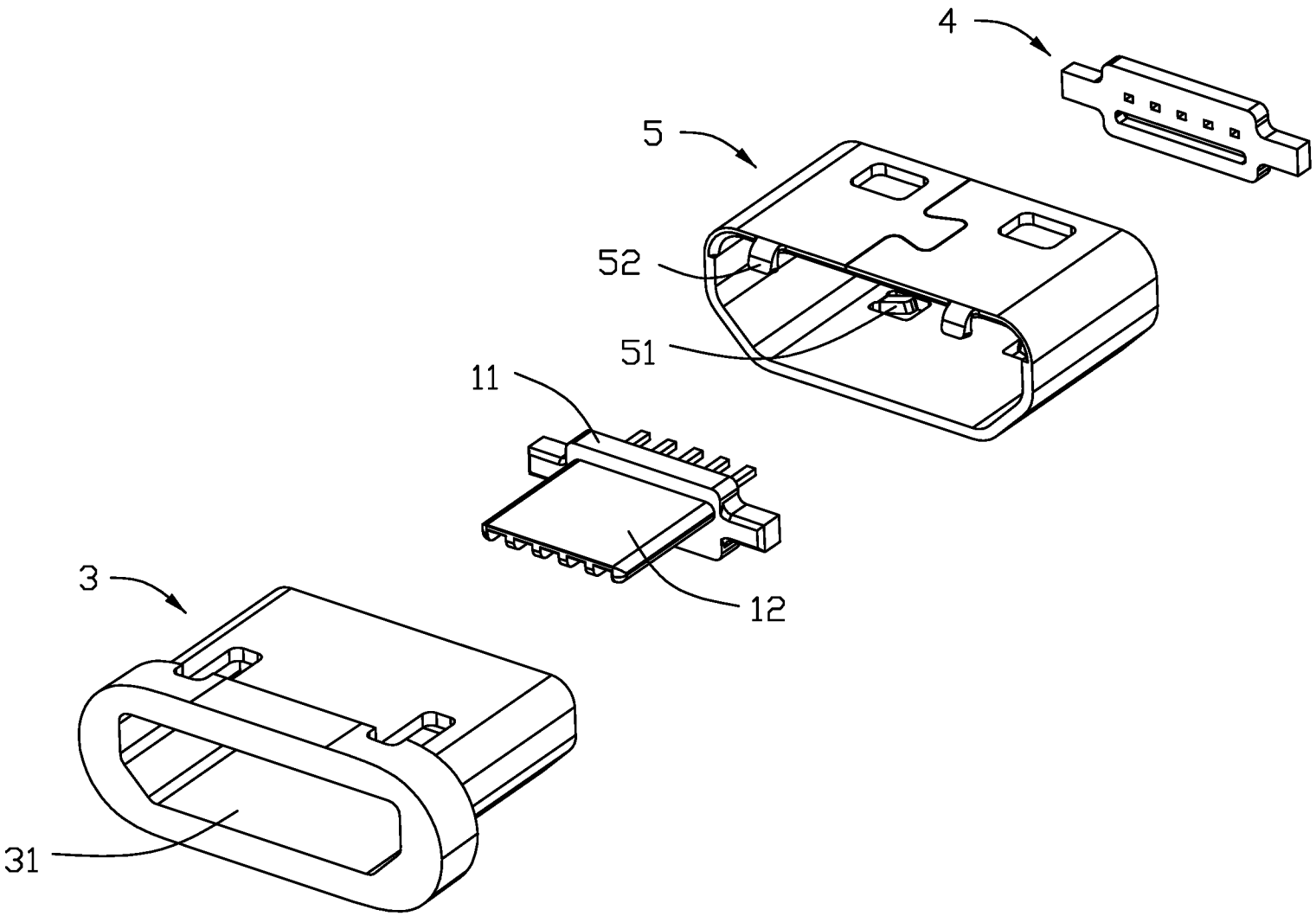
FIG. 3 is an exploded view of the electrical connector.
Figure 4:
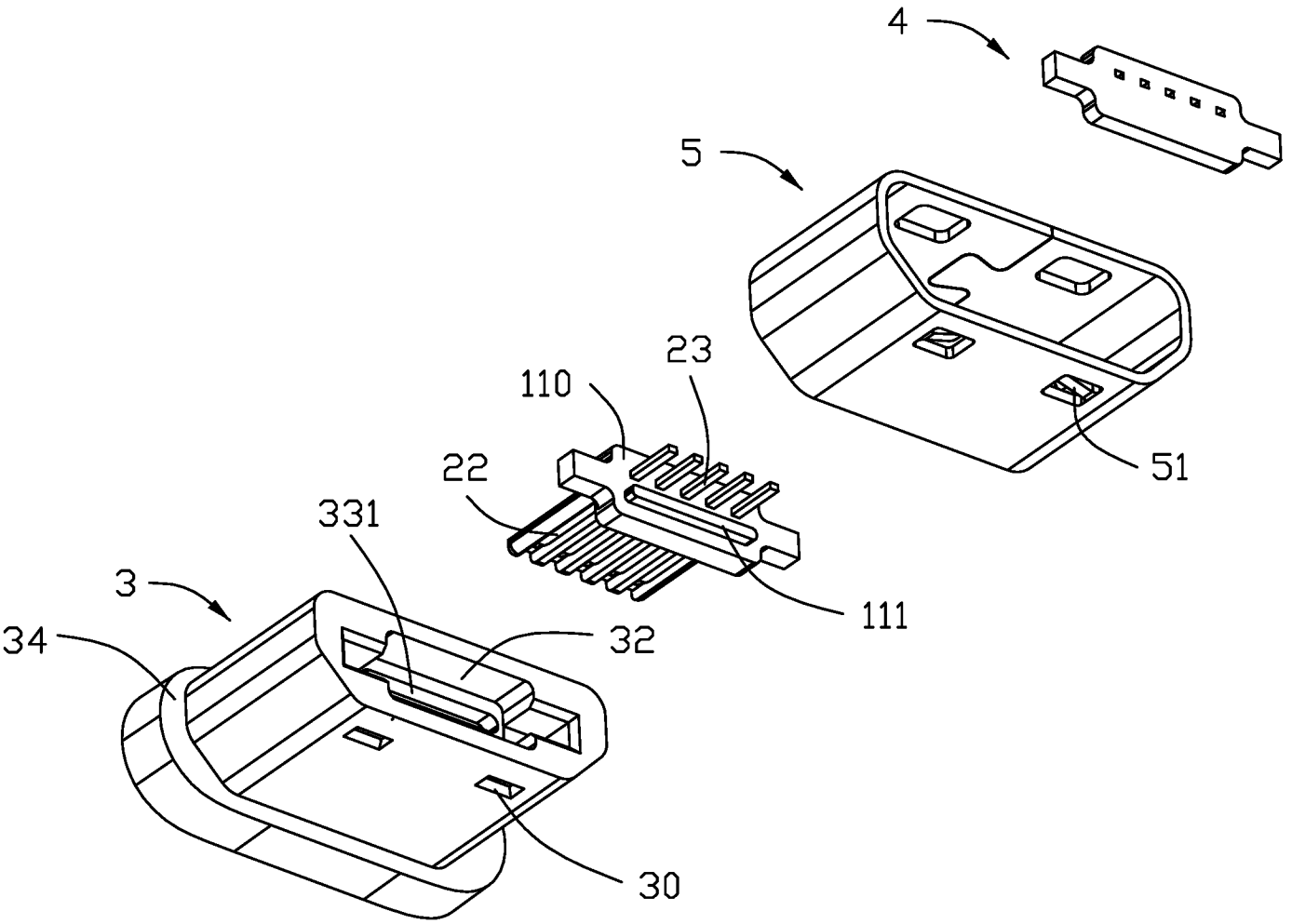
FIG. 4 is another exploded view of the electrical connector.
Figure 5:
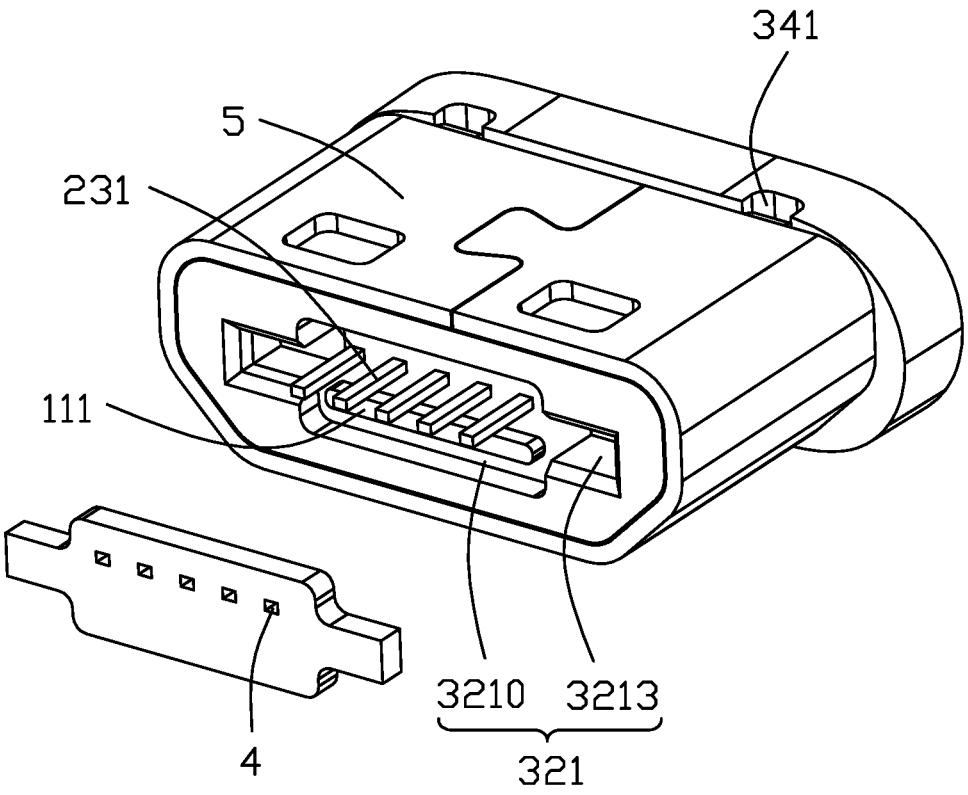
FIG. 5 shows the electrical connector prior to forming a sealing member thereof.
Figure 6:
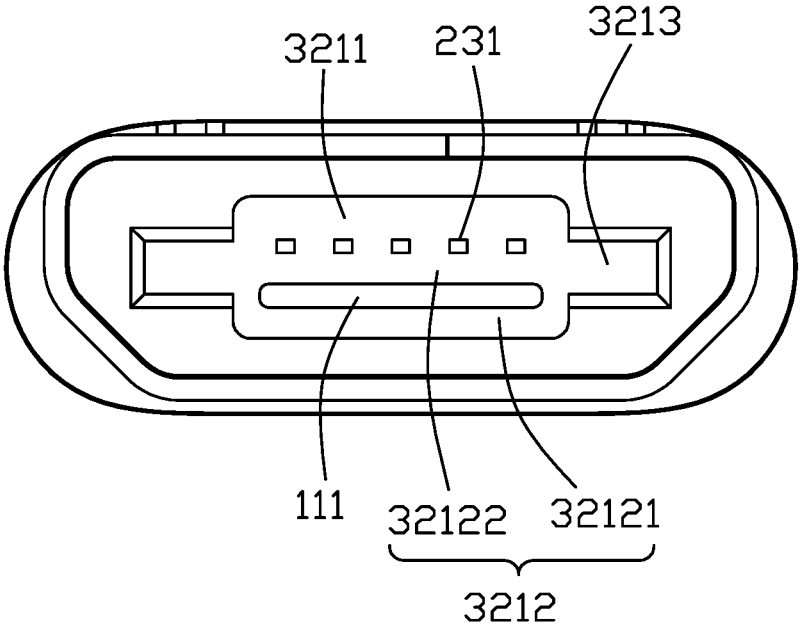
FIG. 6 is a rear plan view of the electrical connector in FIG. 5 omitting the sealing member.
Figure 7:
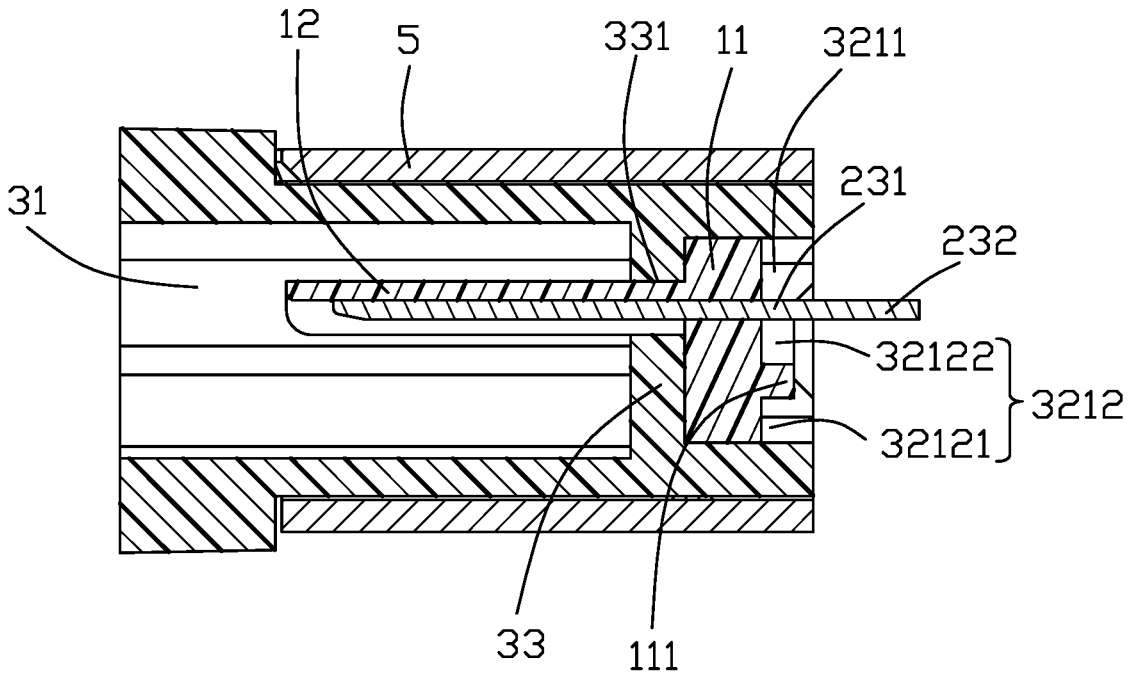
FIG. 7 is a cross-sectional view of FIG. 6.
Figure 8:
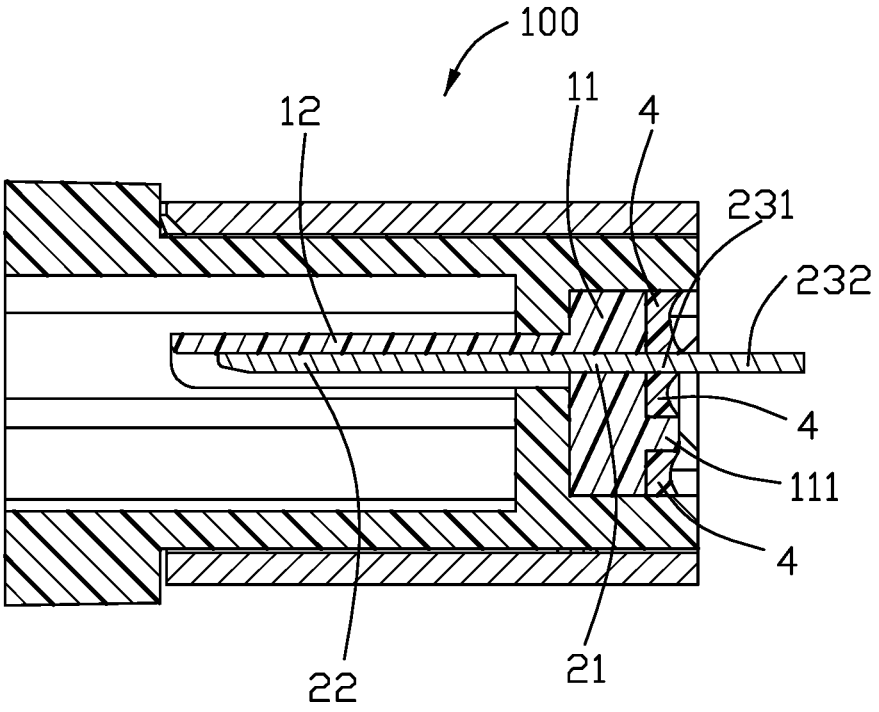
FIG. 8 is a view similar to FIG. 7 but showing the sealing member in place.

Referring to FIGS. 1 to 8, an electrical connector 100 comprises an insulative housing 1, a plurality of contacts 2 secured in the insulative housing 1, an outer cover 3 enclosing the insulative housing 1, and a sealing member 4 disposed behind the insulative housing 1.

The insulative housing 1 includes a base 11 and a tongue 12. The plurality of contacts 2 are arranged in a row and each include a securing portion 21 secured to the base 11, a contacting portion 22 exposed to the tongue 12, and a tail 23 extending rearward beyond a rear face 110 of the base 11.

The outer cover 3 has a mating chamber 31 opening forwardly, a mounting chamber 32 opening rearwardly, and a dividing wall 33 therebetween with a hole 331. The base 11 is forwardly inserted into the mounting chamber 32 with a front face thereof abutting the dividing wall 33 and with the tongue 12 extending into the mating chamber 31. After the base 11 is mounted in place, a rear chamber 321 is defined between the base and the outer cover 3. The tail 23 of each of the plurality of contacts 2 has an embedded portion 231 within the rear chamber 321 and a soldering portion 232 outside the the rear chamber 321. The embedded portions 231 generally divide the rear chamber 321 into an upper region 3211 and a lower region 3212 larger in area than the upper region 3211. The sealing member 4 is formed by glues cured in the rear chamber 321 and functions to seal an interface between the base 11 and the outer cover 3 on one hand and an interface between the base 11 and the contacts 2 on the other hand for waterproof purpose.

Figure 9:
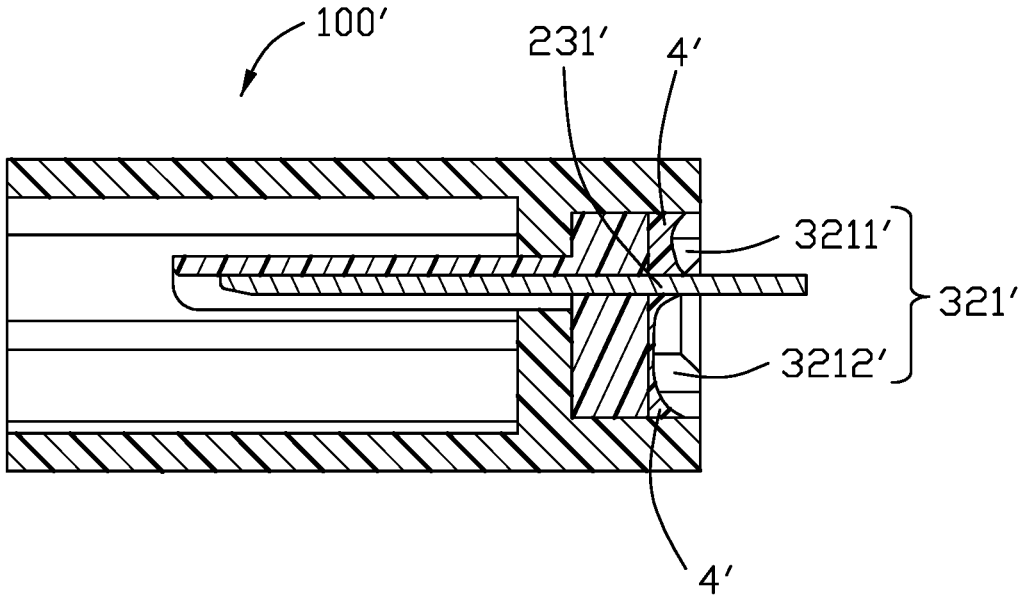
FIG. 9 (PRIOR ART)
FIG. 9 is a view similar to FIG. 8 but showing a design without a rib.

FIG. 9 shows an electrical connector 100' having a rear chamber 321' divided by the embedded portions 231' into an upper region 3211' and a lower region 3212' larger in area than the upper region 3211'. After a sealing member 4' is cured in the rear chamber 321', a portion of the glues in the larger region 3212' around transverse sides thereof may not be reliably sealed.

Referring again to FIGS. 1 to 8, in the electrical connector 100, the base 11 has a rear face 110 and a rib 111 is disposed in the lower region 3212 to protrude rearward from the rear face 110 into the rear chamber 321. The rib 111 divides the lower region 3212 into a first part 32121 below the rib 111 and a second part 32122 above the rib 111. By dividing the large lower region 3212 into two small first and second parts 32121 and 32122 improves distribution or flowing of the glues during forming the sealing member 4. In addition, by presence of the rib 111, total amount of glues used or needed may be reduced.

The tongue 12 snugly fits in the hole 331. Both the mounting chamber 32 and the base 11, and therefore the rear chamber 321, are roughly cross-shaped. The rear chamber 321 has a center part 3210 and two side parts 3213. A height or vertical dimension of the center part 3210 is grater than that of the side part 3213. The contacts 2 are located within the center part 3210. The upper region 3211 and the lower region 3212 constitute the center part 3210. The rib 111 is also located within the center part 3210. The embedded portions 231 of the contacts 2 span a transverse extent less than a transverse extent of the rib 111.

The outer cover 3 is made of insulative material in order to have a better bonding with the sealing member 4. The electrical connector 100 may further include a metallic shell 5 enclosing the outer cover 3. The cover 3 has recesses 30 and the shell 5 has fingers 51 for engaging the recesses 30. The cover 3 may further include a front annular stop 34 having notches 341 and the shell 5 has clips 52 for engaging the notches 341.

What is claimed is:

1. An electrical connector comprising: an insulative housing having a rear base and a front tongue; a plurality of contacts extending rearward through the base and exposing to the tongue; an outer cover enclosing the insulative housing to define a rear chamber therebetween; and a sealing member formed in the chamber to seal an interface between the base and the outer cover and an interface between the base and the contacts; wherein the base has a rear face and a rib protruding rearward from the rear face into the rear chamber; wherein each of the plurality of contacts has a tail with an embedded portion and a soldering portion, the embedded portions dividing the chamber into an upper region and a lower region larger in area than the upper region, and the rib is disposed in the lower region; wherein the embedded portions of the plurality of contacts span a transverse extent less than a transverse extent of the rib.

2. The electrical connector as claimed in claim 1, wherein the outer cover is insulative.

3. The electrical connector as claimed in claim 2, further comprising a metallic shell enclosing the outer cover.

* * * * *